US006968903B2

(12) United States Patent
Pollard

(10) Patent No.: US 6,968,903 B2
(45) Date of Patent: Nov. 29, 2005

(54) ORIENTABLE WHIPSTOCK TOOL AND METHOD

(75) Inventor: Michael E. Pollard, Houston, TX (US)

(73) Assignee: TIW Corporation, Houston, TX (US)

( * ) Notice: Subject to any disclaimer, the term of this patent is extended or adjusted under 35 U.S.C. 154(b) by 0 days.

(21) Appl. No.: 10/668,731

(22) Filed: Sep. 23, 2003

(65) Prior Publication Data

US 2005/0145381 A1 Jul. 7, 2005

(51) Int. Cl.[7] ..... E21B 7/08
(52) U.S. Cl. ..... 166/382; 166/50; 166/117.6; 175/80; 175/82
(58) Field of Search ..... 166/50, 117.6, 166/382; 175/80, 81, 82, 61

(56) References Cited

U.S. PATENT DOCUMENTS 1,901,454 A * 3/1933 Kelly ..... 166/290
1,923,448 A * 8/1933 McCoy et al. ..... 166/117.5
2,132,061 A * 10/1938 Walker ..... 166/117.6
6,012,516 A * 1/2000 Brunet ..... 166/50
6,209,635 B1 * 4/2001 Gotlib et al. ..... 166/117.5
6,360,821 B1 * 3/2002 Braddick ..... 166/117.6
2002/0070018 A1 * 6/2002 Buyaert ..... 166/255.3

* cited by examiner

*Primary Examiner*—Hoang Dang
(74) *Attorney, Agent, or Firm*—Browning Bushman P.C.

(57) ABSTRACT

A whipstock assembly includes a whipstock body 8 having a whipstock center of gravity offset radially from the central axis of the whipstock body, a counterweight to releasably secured to the whipstock body, with a counterweight having an offset counterweight center of gravity, an orientation device 5, and a neutralizer 11. The neutralizer causes the combined whipstock/neutralizer center of gravity to be substantially closer to the central axis of the whipstock body compared to the whipstock center of gravity. An attaching mechanism 6, 12 allows the neutralizer to be returned to the surface after the whipstock body is set in the well.

16 Claims, 4 Drawing Sheets

ORIENTABLE WHIPSTOCK TOOL AND METHOD

FIELD OF THE INVENTION

The present invention relates to whipstock assemblies and, more particularly, to an improved whipstock assembly and method for positioning the whipstock face at a selected azimuth within a well bore.

BACKGROUND OF THE INVENTION

Whipstock assemblies have been lowered into well bores for over 100 years to conduct directional or sidetrack drilling. In many applications, a whipstock assembly is lowered into the well on a tubular string, including a coiled tubing string, but in other applications the whipstock is lowered into the well by a wireline or an electric line. In either event, it is not a simple task to controllably rotate the whipstock in the well so that the whipstock face is at a selected azimuth for a desired directional drilling operation, and the consequences of the whipstock being improperly oriented when starting the directional drilling operation may be very costly.

One common technique for orienting a whipstock in the well utilizes a counterweight. A counterweight, like a clock pendulum, seeks its lowest point. A whipstock with a counterweight acts like a pendulum, trying to orient the whipstock face to the high side. Selectively orienting the whipstock by use of a counterweight to any desired orientation when in an inclined portion of the borehole, despite the whipstock's natural tendency, is similar to selectively orienting a clock pendulum by attaching to it a second, heavier clock pendulum at a proper relative orientation with a common pivot point. This technique for selectively orienting a whipstock face in a well has been used for decades, in spite of the inherent disadvantages in both the cost and the axial length required to ensure that the counterweight has sufficient capability to orient the whipstock face to the desired orientation in the well.

The disadvantages of the prior art are overcome by the present invention, and an improved whipstock assembly and method for orienting whipstock assembly in a well are hereinafter disclosed.

DETAILED DESCRIPTION OF PREFERRED EMBODIMENTS

Figure 8:
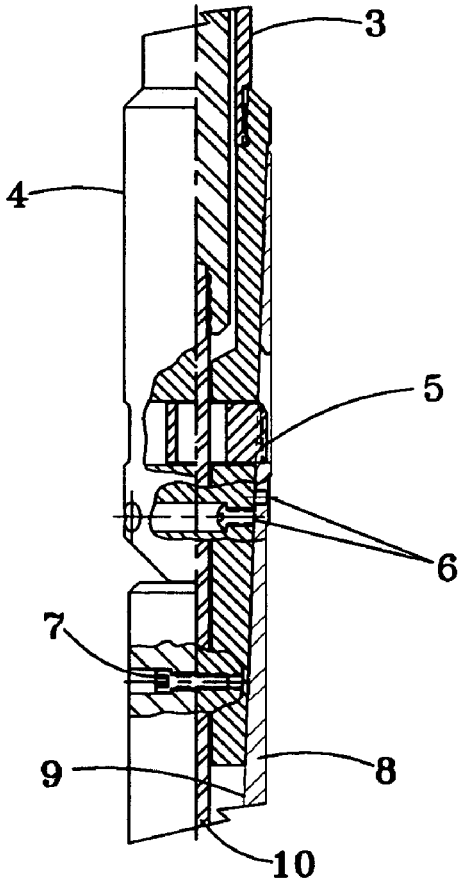
FIG. 8 is a half sectional view illustrating a position of the setting assembly relative to the whipstock body during the setting process, including contact of the key with the bottom of the slot in the whipstock body following the shearing of the shearable fasteners.
Figure 9:
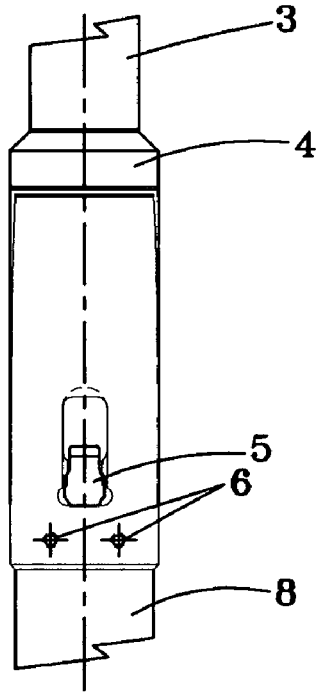
FIG. 9 is a top view of FIG. 8 illustrating the relative location of the key to the whipstock body following the shearing of the fasteners.
Figure 10:
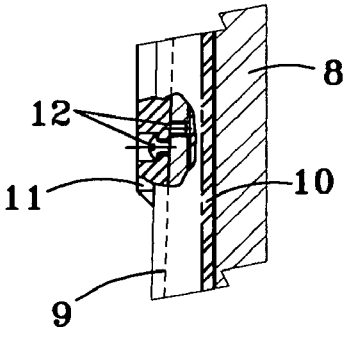
FIG. 10 is a half sectional view illustrating the relative position of the neutralizer to the whipstock body following the shearing of the shearable fasteners.
Figure 12:
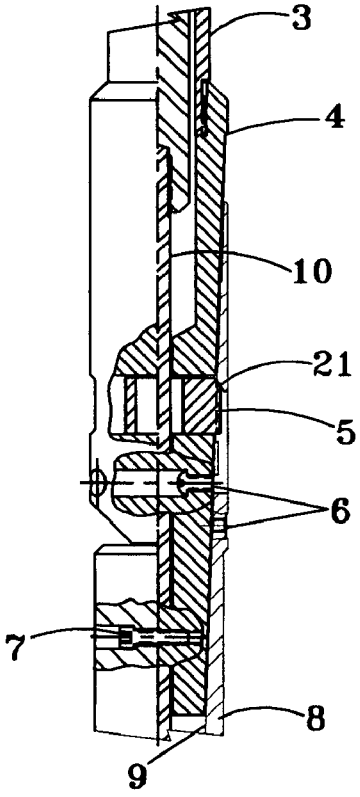
FIG. 12 is a half sectional view illustrating the key moved radially inward due to angled contact with the upper end of the slot in the whipstock body.
Figure 11:
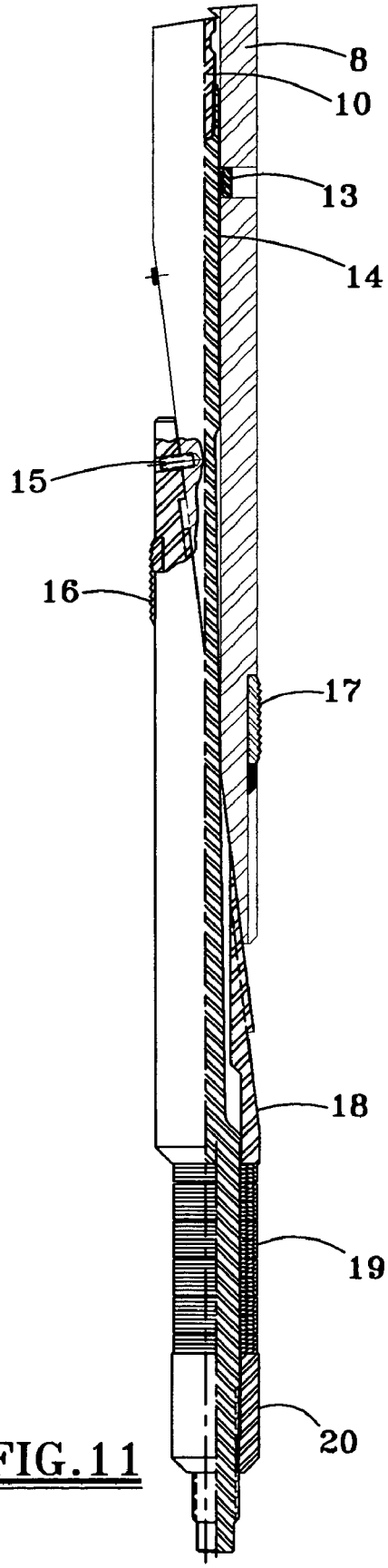
FIG. 11 is a half sectional view illustrating a lower portion of the whipstock assembly prior to the completion of the setting operation.

After the whipstock assembly is run in the well at a desired depth, deliberate actuation of the bidirectional setting tool 3 produces an upward force on the setting rod 10 substantially equal and opposite to the downward force on the connector sub 4/neutralizer 11 assembly. As the forces increase, the shearable fastener(s) 6, 12 connecting the connector sub 4/neutralizer 11 assembly to the whipstock body 8 shear, allowing the connector sub 4/neutralizer 11 assembly to move a short distance in a downward direction relative to the whipstock body 8, as shown in FIGS. 8, 9 and 10. In this process, a key 5 is brought into axial contact with the whipstock body 8, thereby rededirecting the downward load path, as shown in FIGS. 8 and 9. At some stage, the upward force acting on the setting rod 10, through the locking mandrel 14, nut 20, belleville washers 19 and wedge 18, causes the wedge shear pin(s) 15 between the whipstock body 8 and the wedge 18 to shear, allowing the wedge 18 to move upward and radially outward, until the body slip(s) 17 and wedge slip(s) 16 contact the casing wall, forcing the whipstock body 8 into the set position. After the whipstock body 8 has been reliably set, locked by the interaction of the locking mechanism 13 and the locking mandrel 14, the upward force may be increased to a level which tensionally fractures a calibrated area of the setting rod 10, allowing the entire setting assembly to be freely detached from the whipstock body 8. Picking up on the setting assembly then brings the upper beveled surface 21 of the key 5 into engagement with the upper beveled surface at the top of the slot in the whipstock body 8, thereby forcing the key 5 radially inward, thereby disengaging the key 5 from the whipstock body 8, as shown in FIG. 12.

A key 5 allows this radial movement, with the setting rod 10 passing through the bore in the neutralizer 11 and then through the central bore in the whipstock body 8. Once the connector sub 4 and neutralizer 11 are released from the whipstock body 8, the run-in string including the neutralizer 11 and the counterweight 2 may be retrieved to the surface, with the whipstock body 8 remaining set in the well. The counterweight 2 is releasably securable to the whipstock body, and has an offset counterweight center of gravity such that the counterweight occupies a low side of the wellbore.

Figure 1:
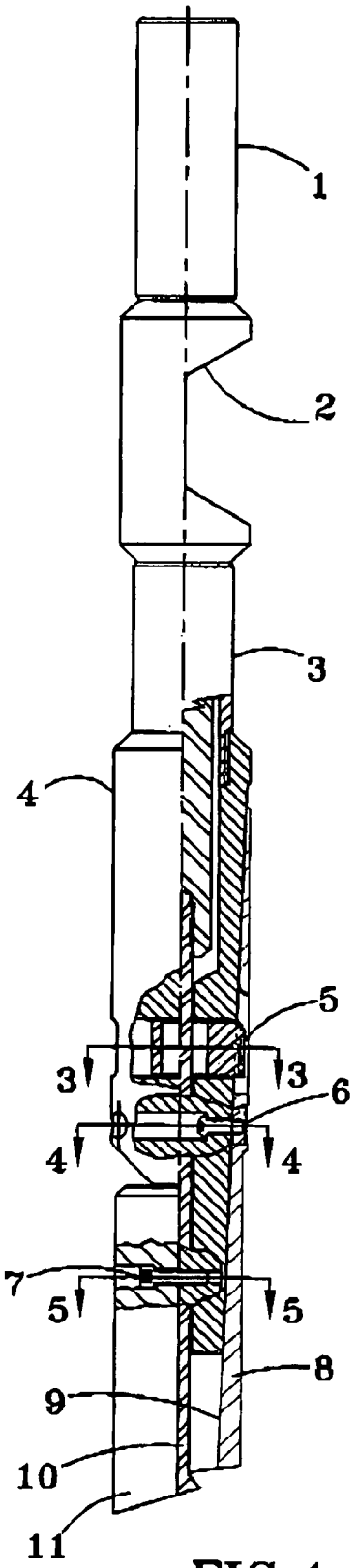
FIG. 1 is a half sectional view of an upper portion of a suitable whipstock tool according to the present invention, including a connector sub for selectively orienting the whipstock face relative to a counterweight positioned above the whipstock body.

Threads between the counterweight 2 and the setting tool 3, and/or between the setting tool 3 and the connector sub 4, as shown in FIG. 1, may be selectively made up and pinned to act as an orientation device to orient the whipstock face at a selected rotational position relative to the counterweight.

In a preferred embodiment, the neutralizer may occupy the unutilized space of the volume that was removed on the whipstock body during the manufacture of the whipstock body, i.e., the space radially outward of the whipstock face. The whipstock body 8 has a whipstock center of gravity offset radially from a central axis of the whipstock body. The neutralizer 11 is releasably secured to the whipstock body, and has a neutralizer center of gravity radially opposite the whipstock center of gravity with respect to the central axis of the whipstock body. The combined whipstock/neutralizer center of gravity is substantially closer to the central axis of the whipstock body than the whipstock center of gravity. Also, the neutralizer may be removed from the whipstock body in order to allow additional confidence in the ability to set for a highside exit. For a highside exit, a counterweight may thus not be required.

Figure 2:
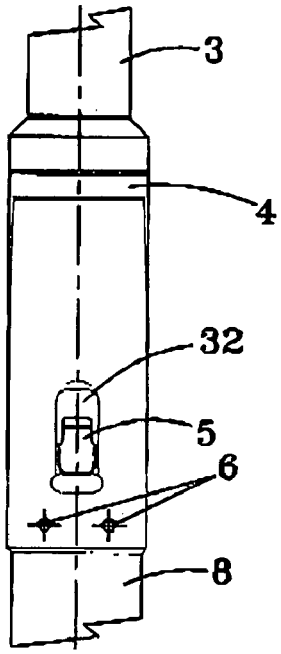
FIG. 2 is a top view of a portion of FIG. 1, showing a key positioned a short distance from the bottom of a slot in the whipstock body in the run-in position.
Figure 3:
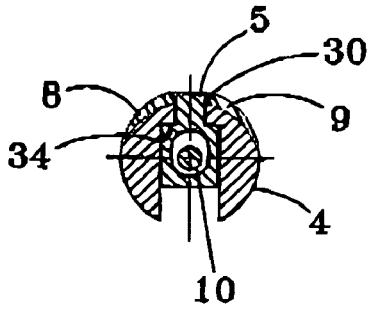
FIG. 3 is a cross sectional view illustrating the engagement of the key with the whipstock body while housed inside a connector sub.
Figure 4:
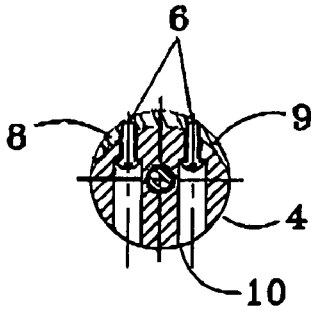
FIG. 4 is a cross sectional view illustrating a method of releasably securing a connector sub to the whipstock body using one or more shearable fasteners in the run-in position.
Figure 5:
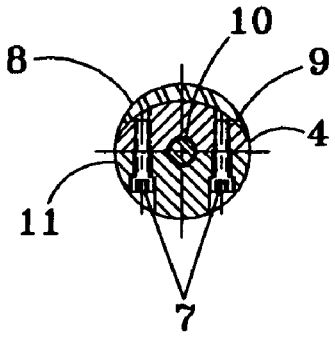
FIG. 5 is a cross sectional view illustrating a method of releasably securing the neutralizer to the connector sub using one or more fasteners.
Figure 6:
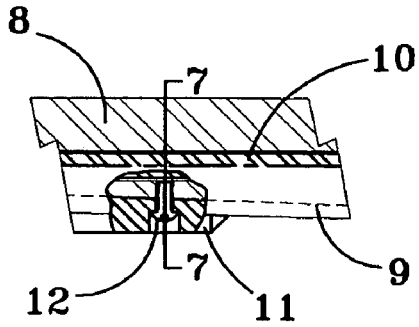
FIG. 6 is a half sectional view illustrating a method of releasably securing the neutralizer to the whipstock body using one or more shearable fasteners.
Figure 7:
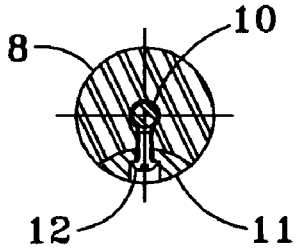
FIG. 7 is a cross sectional view of illustrating a method of releasably securing the neutralizer to the whipstock body using one or more shearable fasteners.

In a preferred embodiment, a feature of the key and the whipstock body would include tabs 30 on one of the key and whipstock body, as shown in FIG. 3, to prevent premature retraction of the key from the whipstock body. A slot in the whipstock body preferably includes a relief section 32, as shown in FIG. 2 which allows retraction of the key only after the whipstock has been fully set in the well. Each of the key and a connector sub may include mating surfaces 34 as shown in FIG. 3 to prevent the key from excessive movement radially outward, thereby preventing the key from extending beyond the desired diameter. Shear pin 12 may be used to limit movement of the neutralizer with respect to the whipstock body prior to setting the whipstock. The shear pin 12 and the key 5 together may constitute a detaching mechanism for releasing the neutralizer from the whipstock body.

In a particular feature of the invention, the whipstock assembly does not include a setting tool or counterweight. A customer may thus be able to select the vendor of their choice for a desired setting tool/weight combination. Also, the system is significantly shorter than prior art systems, and most of the assembly can be put together in the comfort of a shop. The assembly may then be transported to the well site, so that full assembly that is not already done, may be accomplished by adding the counterweight, which is now shorter than the conventional counterweight, the setting tool, and orientation instrumentation.

Should the customer decide to use a tool that has the ability to rotate the whipstock assembly, as opposed to simply measuring orientation, the neutralizer system may reduce the torque required to be produced by the orientation tool, thereby making it feasible to use the whipstock orientation tool that otherwise may be too small toward the operation.

Figure 13:
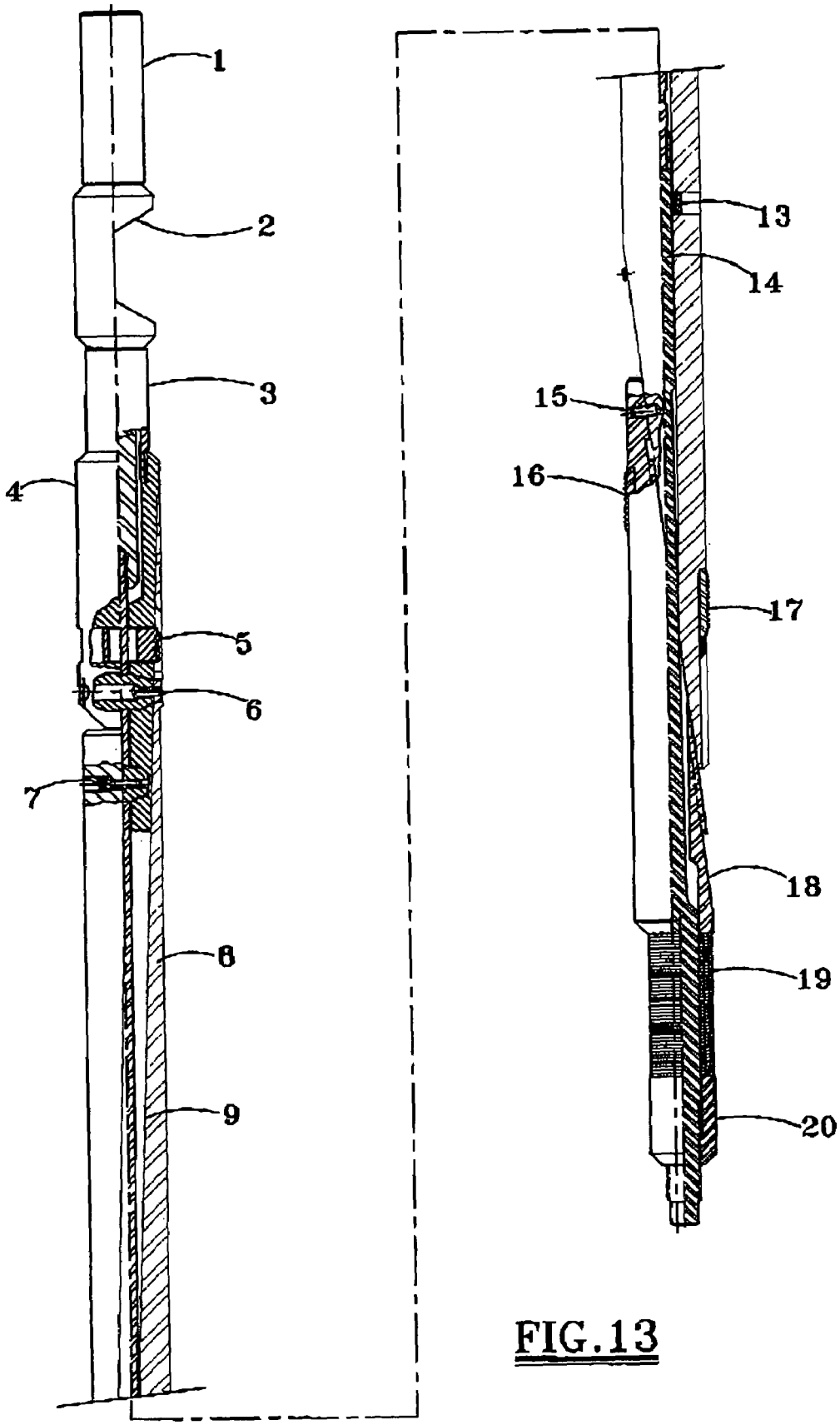
FIG. 13 is an assembly drawing with the center section removed.

The initial downward movement of the neutralizer ensures clean and complete shearing of the shear pin. This allows for effortless removal of the neutralizer once setting of the whipstock is complete. Because the key fits into a slot in the body, which has a top end termination, less capture area or strength to the whipstock body is compromised than the prior art systems in which the slot in the body runs out. A beveled interface between the two members allows the use of a relatively short slot. In one embodiment, the inclined face of the whipstock body intercepts a substantially cylindrical outer surface of the whipstock body, and the counterweight includes an outer substantially cylindrical surface with substantially the same diameter as the outer surface of the whipstock body. As shown in FIG. 13, at least a portion of the neutralizer includes an engagement surface for substantially planar contact with the whipstock face when the neutralizer is secured in a whipstock body.

The setting rod assembly may move a cam profile attached to a part of the setting rod assembly, thereby moving the neutralizer with respect to the body. The attachment mechanism, whether shear pins or otherwise, may be partially or completely disengaged by the cam profile to separate the neutralizer body without the need to have the key stand off from the end of the slot in the whipstock body. The use of small keyways on both whipstock body and additional keys on the neutralizer may include tapering the upper part of the slot. Because no standoff would be necessary, no extra stroke of the setting tool need be used. In addition, the use of shear pins, except for the wedge shear pins, may not be necessary. To disengage from the whipstock body, downward stroke of the neutralizer may shear the pin, and a key standoff accomplishes this goal. The use of strong shear pins between the neutralizer and the body are preferred. Once setting is complete, the remaining stroke and the setting tool may be used to drive a cam and forceably pry the neutralizer from the body. No key may be required for this method.

If the whipstock is run in on coiled tubing with a swivel, hydraulic pressure from the surface may be used to act on a piston to move the piston within a connector sub. The piston may separate the neutralizer from the whipstock body by either pushing, pulling, or prying, but the separation should not be accomplished until after the whipstock body has been set.

The neutralizer may be attached with very strong shear pins to the whipstock body. The neutralizer may thus remain attached through the entire setting process. Removal of the neutralizer could be accomplished by overpull or by jarring up or down when the whipstock is run in the well on coiled tubing. When the assembly is run in on a wire line, the use of spang jars to jar up in or down may be used to remove the neutralizer. The neutralizer may be attached with bolts to the whipstock body, but the bolts not fully made up. A key and keyway connection may thus be used so that there is ample clearance between the key and the keyway. Springs may also be placed between the whipstock body and the neutralizer, tending to move one or more neutralizer pads radially outward and thereby increasing its effectiveness. This biased neutralizer system may allow the assembly to pass through reasonable restrictions. Removal of the neutralizer after the setting may be accomplished by any desired method.

Further details with respect to a suitable whipstock body 8 are disclosed in U.S. Pat. No. 6,360,821, hereby incorporated by reference.

While preferred embodiments of the present invention have been illustrated in detail, it is apparent that other modifications and adaptations of the preferred embodiments will occur to those skilled in the art. The embodiments shown and described are thus exemplary, and various other modifications to the preferred embodiments may be made which are within the spirit of the invention. Accordingly, it is to be expressly understood that such modifications and adaptations are within the scope of the present invention, which is defined in the following claims.

What is claimed is:

1. A whipstock assembly for positioning in a well bore at a selected azimuth, the whipstock assembly comprising:

a whipstock body supporting an inclined whipstock face, the whipstock body having a whipstock center of gravity offset radially from a central axis of the whipstock body;

a counterweight releasably securable to the whipstock body, the counterweight having an offset counterweight center of gravity such that a portion of the counterweight tends to occupy a low side of the well bore;

an orientation device for selectively orienting the whipstock face at a selected rotational position relative to the counterweight;

a neutralizer releasably securable to the whipstock body, the neutralizer being positioned relative to the whipstock body such that a neutralizer center of gravity is radially opposite the whipstock center of gravity with respect to the central axis of the whipstock body, the neutralizer being removeably attached from the whipstock body;

a combined whipstock/neutralizer center of gravity is substantially closer to the central axis of the whipstock body than the whipstock center of gravity to reduce the mass of the counterweight; and a detaching mechanism for selectively releasing the neutralizer from the whipstock body, such that the neutralizer may be returned to the surface after the whipstock body is set in the well.

2. A whipstock assembly as defined in claim 1, wherein the inclined whipstock face of the whipstock body intercepts a substantially cylindrical outer surface of the whipstock body, and the counterweight includes an outer substantially cylindrical surface with substantially the same diameter as the outer surface of the whipstock body.

3. A whipstock assembly as defined in claim 1, wherein the neutralizer includes an engagement surface for substantially planar engagement with the whipstock face when the neutralizer is secured to the whipstock body.

4. A whipstock assembly as defined in claim 1, wherein the neutralizer occupies a volume removed from the whipstock body during manufacture of the whipstock body.

5. A whipstock assembly as defined in claim 1, wherein one of a radially moveable key and whipstock body include tabs to prevent premature retraction of the key from the whipstock body.

6. A whipstock assembly as defined in claim 5, wherein a slot in the whipstock body includes a relief section to allow retraction of the key after the whipstock has been set in the well.

7. A whipstock assembly as defined in claim 5, wherein each of the key and a connector sub include mating shoulder to limit radially outward movement of the key.

8. A whipstock assembly as defined in claim 1, wherein shear pins limit movement of the neutralizer with respect to the whipstock body.

9. A whipstock assembly for positioning in a well bore at a selected azimuth, the whipstock assembly comprising:

a whipstock body supporting an inclined whipstock face, the whipstock body having a whipstock center of gravity offset radially from a central axis of the whipstock body;

a counterweight releasably securable to the whipstock body, the counterweight having an offset counterweight center of gravity such that a portion of the counterweight tends to occupy a low side of the well bore:

a neutralizer releasably securable to the whipstock body, the neutralizer being positioned relative to the whipstock body such that a neutralizer center of gravity is radially opposite the whipstock center of gravity with respect to the central axis of the whipstock body;

a combined whipstock/neutralizer center of gravity is substantially closer to the central axis of the whipstock body than the whipstock center of gravity to reduce the mass of the counterweight; and a detaching mechanism for selectively releasing the neutralizer from the whipstock body, such that the neutralizer may be returned to the surface after the whipstock body is set in the well.

10. A whipstock assembly as defined in claim 9, wherein the inclined whipstock face of the whipstock body intercepts a substantially cylindrical outer surface of the whipstock body, and the counterweight includes an outer substantially cylindrical surface with substantially the same diameter as the outer surface of the whipstock body.

11. A whipstock assembly as defined in claim 9, wherein the neutralizer includes an engagement surface for substantially planar engagement with the whipstock face when the neutralizer is secured to the whipstock body.

12. A whipstock assembly as defined in claim 9, wherein one of a radially moveable key and whipstock body include tabs to prevent premature retraction of the key from the whipstock body.

13. A whipstock assembly as defined in claim 9, wherein shear pins limit movement of the neutralizer with respect to the whipstock body.

14. A method of positioning a whipstock assembly in a wellbore at a selected azimuth, the method comprising:

providing a whipstock face on a whipstock body, the whipstock body having a whipstock center of gravity offset radially from a central axis of the whipstock body;

releasably securing a counterweight to the whipstock body, the counterweight having an offset counterweight center of gravity such that a portion of the counterweight tends to occupy a low side of the wellbore;

releasably securing a neutralizer to the whipstock body, the neutralizer being positioned relative to the whipstock body such that a neutralizer center of gravity is radially opposite the whipstock center of gravity with respect to the central axis of the whipstock body, and the combined whipstock/neutralizer center of gravity is substantially closer to the central axis of the whipstock body than the whipstock center of gravity to reduce the mass of the counterweight;

running the whipstock body and the neutralizer in a well; and selectively releasing the neutralizer from the whipstock body, such that the neutralizer may be returned to the surface after the whipstock body is set in the well.

15. The method as defined in claim 14, wherein an engagement surface on the neutralizer is in substantially planar engagement with the whipstock face when the neutralizer is secured to the whipstock body.

16. The method as defined in claim 14, further comprising:

providing a radially moveable key, one of the key and the whipstock body including tabs to prevent premature retraction of the key from the whipstock body.

* * * * *